United States Patent [19]

Tanigawa

[11] Patent Number: 4,767,979

[45] Date of Patent: Aug. 30, 1988

[54] SWITCHING CIRCUIT DEVICE USING CURRENT MIRROR CIRCUITS

[75] Inventor: Hiroshi Tanigawa, Saitama, Japan

[73] Assignee: Toko, Inc., Japan

[21] Appl. No.: 68,523

[22] Filed: Jul. 1, 1987

[30] Foreign Application Priority Data

Jul. 10, 1986 [JP] Japan ..... 61-105753

[51] Int. Cl.[4] ..... G05F 3/26

[52] U.S. Cl. ..... 323/316; 323/315; 323/351

[58] Field of Search ..... 323/312, 315, 316, 350, 323/351, 354; 307/297

[56] References Cited

U.S. PATENT DOCUMENTS 4,408,190 10/1983 Nagano ..... 323/315 X 4,608,530 8/1986 Bacrania ..... 323/351 X

*Primary Examiner*—Patrick R. Salce

*Assistant Examiner*—Kristine Peckman

[57] ABSTRACT

In a switching circuit device using current mirror circuits, there are provided a first group of current mirror circuits wherein a plurality of signal currents supplied via input terminals are superimposed upon mirror currents and signal currents resulting from the superimposition are derived as new mirror currents; and a second group of current mirror circuits to which the new mirror currents are supplied. The output stages of the second group of current mirror circuits are connected to each other at a common point which in turn is tied to the output stage of a current mirror circuit for supplying a mirror current of a predetermined magnitude. An output terminal is led out of said common point. Bias voltage for said second group of current mirror circuits is controlled so that any desired signal current is selected from said plurality of signal currents.

2 Claims, 3 Drawing Sheets

SWITCHING CIRCUIT DEVICE USING CURRENT MIRROR CIRCUITS

BACKGROUND OF THE INVENTION

1. Field of the Invention

This invention relates to a switching circuit device using current mirror circuits, and more particularly it pertains to such a switching circuit device which is operable with a low supply voltage and capable of selecting a desired one of a plurality of input signals, thereby achieving switching control of analog signals.

2. Description of the Prior Art

To have a better understanding of the present invention, description will first be made of a conventional switching circuit device illustrated in FIG. 1, wherein differential amplifiers which correspond in number to input signals, are provided, and a current source transistor of each differential amplifier is controlled to select a desired signal.

More specifically, the conventional switching device includes a first differential amplifier circuit A1 comprising a differential pair of transistors Q100 and Q101, an active load circuit constituted by a diode D100 and transistor Q102, and a feedback transistor Q103 and current source transistor Q104; and a second differential amplifier circuit A2 comprising transistors Q105 to Q109 and a diode D101 which are connected in a fashion similar to the first differential amplifier A1. The differential amplifiers A1 and A2 have their output terminals coupled to a common output terminal IOUT. The transistors Q100 and Q105 have their bases connected to input terminals IIN1 and IIn2 respectively. To achieve selection of a desired input signal, the current source transistor Q104 or Q109 is controlled so that the associated one of the differential amplifiers A1 and A2 is operated, thereby selecting the desired input signal.

However, the above-mentioned conventional switching circuit device is disadvantageous in that the number of components is increased due to the fact that it is constituted by using differential amplifiers. Another disadvantage is such that when the foregoing arrangement is provided in the form of a semiconductor integrated circuit, an increased area is required by the signal change-over portion thereof which is adapted for selecting one input signal out of more than two input signals in an alternative way, and obviously this is not preferable from the standpoint of circuit integration. Still another disadvantage is such that because of the fact that differential amplifiers are used and signal selection is effected by controlling the current source transistor of each differential amplifier, a large voltage drop is caused to occur in the differential amplifier so that with a power source voltage as low as about 1 volt, stable opening and closing operation is difficult to achieve.

SUMMARY OF THE INVENTION

The present invention has been made with a view to eliminating the aforementioned problems with the prior art... It is a primary object of the present invention to provide a switching circuit device which is so designed as to be operable with a voltage source as low as about 1 V to 1.5 V.

Another object of the present invention is to provide a switching circuit device capable of selectively deriving a desired signal out of plurality of analog input signals.

To achieve the foregoing objects, the switching circuit device according to the present invention comprises current mirror circuits, wherein at the signal input stage, signal current is superimposed upon a predetermined mirror current, and at the output stage, a mirror current equal to that upon which the input signal current was superimposed, is eliminated and thus the desired signal current is selected.

Briefly stated, according to an aspect of the present invention, there is provided a switching circuit device using current mirror circuits, which includes a first group of current mirror circuits wherein a plurality of signal currents supplied via input terminals are superimposed upon mirror currents and signal currents resulting from the superimposition are derived as new mirror currents; and a second group of current mirror circuits to which the new mirror currents are supplied. The output stages of the second group of current mirror circuits are connected to each other at a common point which in turn is tied to the output stage of a current mirror circuit for supplying a mirror current of a predetermined magnitude. An output terminal is led out of said common point. Bias voltage for said second group of current mirror circuits is controlled so that any desired signal current is selected from said plurality of signal currents.

Other objects, features and advantages of the present invention will become apparent from the ensuing description taken in conjunction with the accompanying drawings.

DESCRIPTION OF THE PREFERRED EMBODIMENTS

Figure 2:
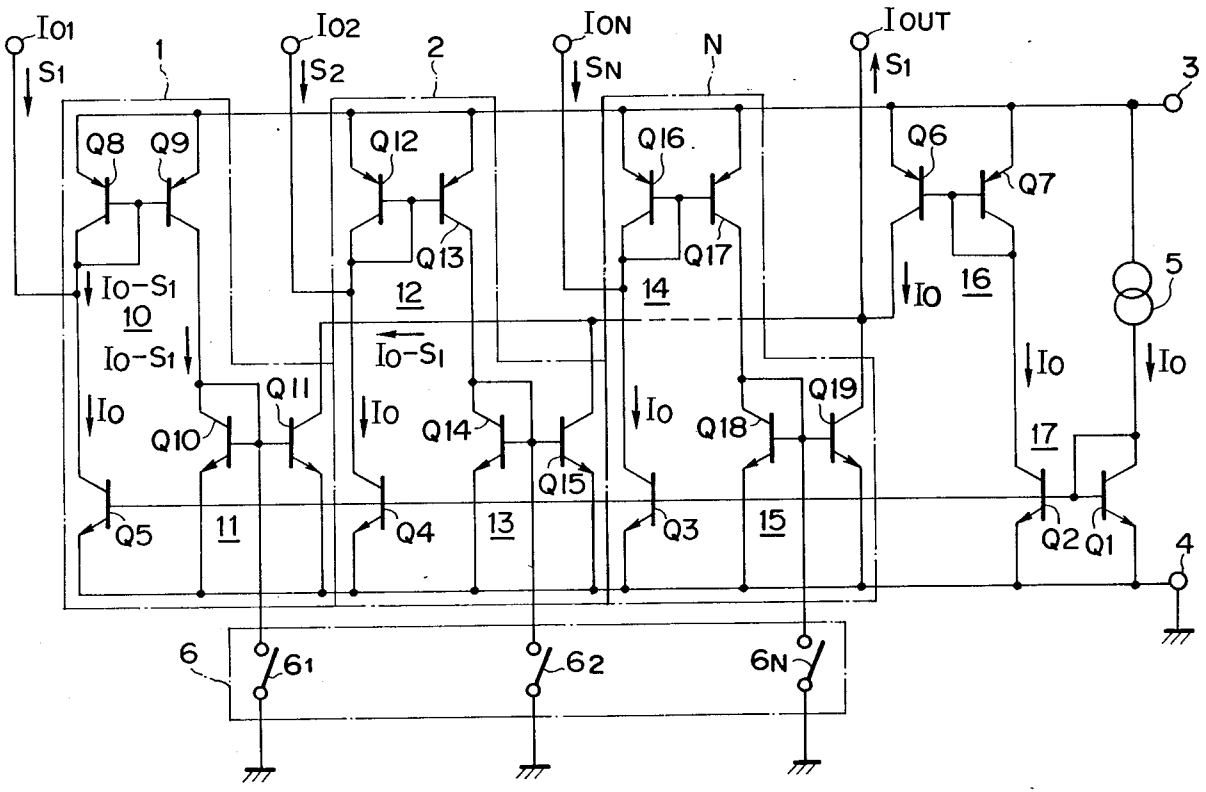
FIG. 2 is a circuit diagram showing the switching circuit device according to an embodiment of the present invention.

Referring to FIG. 2, there is shown the switching circuit device using current mirror circuits according to the present invention, which includes switch circuits 1 to N; a power source terminal 3; a ground terminal 4; a constant current source circuit 5; a switch group 6 comprising switches 61 to 6N each of which may be constituted by a transistor or the like; current mirror circuits 10 to 17; input terminals I01 to I0N; and an input terminal IOUT.

Description will now be made of the operation of the switching circuit device shown in FIG. 2.

Input signal circuits S1 to SN are supplied via the input terminals I01 to I0N to the switch circuits 1 to N respectively. In the switch group 6, the switch 61 is open, while the remaining switches 62 to 6N are closed. The current mirror circuit 17 comprising transistors Q1 to Q5 is arranged such that a constant current I0 is supplied from the constant current source circuit 5 to the transistor Q1 which is connected in a diode-like fashion, and mirror currents I0 are caused to flow from the current mirror circuits 10, 12, 14, and 16 into the output side transistors Q2 to Q5 respectively.

In this case, because of the switch 61 being open, the mirror circuit 11 comprising transistors Q10 and Q11 is operating, and thus the switching circuit 1 is in an "ON" state. Signal current S1, which is superimposed upon the mirror current I0, is supplied, as a new mirror current (I0 - S1), to the current mirror circuit 11. On the other hand, the current mirror circuits 13 and 15 are rendered inoperative since transistors Q14, Q15 and Q18, Q19 constituting these two current mirror circuits have their base electrodes grounded through switches 62 and 6N which are now in "ON" state, respectively. Thus, the switch circuits 2 to N are in "OFF" state, so that the input signal currents S2 to SN are interrupted.

When signal current S1 is provided to the input terminal I01, a constant mirror current will be caused to flow in the collector of the transistor Q5 provided at the output stage of the current mirror circuit 17, and thus, a current (I0 - S1) resulting from superimposition of the signal current −S1 upon the mirror current I0 will be caused to flow out of the collector (cathode) of the transistor Q8 connected in diode-like fashion. Consequently, the current (I0 - S1) is caused to flow in the transistor Q10, which is connected in diode-like fashion, of the current mirror circuit 11 through the transistor Q9 provided at the output side of the mirror pair. Furthermore, input signals S2 to SN supplied via the input terminal I02 to I0N are superimposed upon mirror currents I0 which are caused to flow in the collectors of the transistors Q3 and Q4, and thus currents (I0 - S2) and (I0 - SN) are caused to flow out of the current mirror circuits. However, the transistors Q14, Q15 and Q18, Q19 constituting the current mirror circuits 13 and 15 are rendered non-conductive because of their bases being grounded through the switches 62 and 6N. Thus, no mirror currents are drawn in the transistors Q15 and Q19 at the output sides of the current mirror circuits 13 and 15. Current I0 is caused to flow, as mirror current, out of the current mirror circuit 16, and thus a mirror current (I0 - S1) is supplied to the current mirror circuit 11, so that an extra current is derived, as output current S1, from the output terminal IOUT. In this case, the current mirror circuits 13 and 15 are rendered inoperative, so that signal currents S2 to SN are not derived from the output terminal IOUT.

Figure 1:
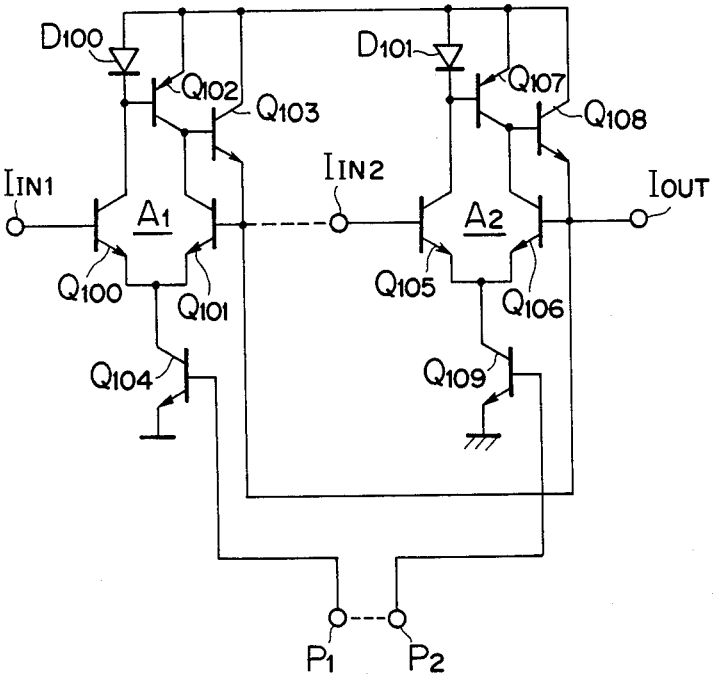
FIG. 1 PRIOR ART
FIG. 1 shows an example of the prior-art switching circuit device.
Figure 3:
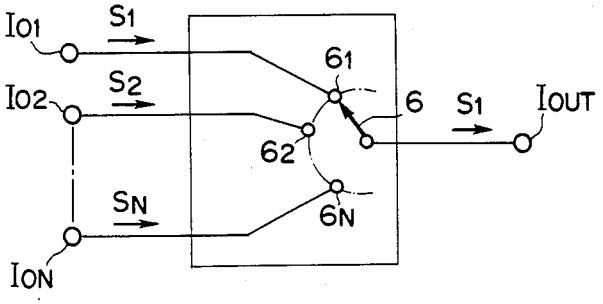
FIG. 3 is a view useful for explaining the outline of the construction of the switching circuit device shown in FIG. 2.

The above-mentioned operation is illustrated in FIG. 3 wherein of the signal currents S1 to SN inputted via the input terminals I01 to I0N, only the signal current S1 inputted via the input terminal I01 is derived from the output terminal IOUT by placing the contact of the switch 6 in engagement with the contact 61.

With the construction of the switching circuit device according to the present invention, voltage drops which occur between the power source terminal 3 and the ground terminal 4, simply include voltages VBE between the bases and the emitters of the transistors and saturation voltages VCE(SAT) between the collectors and the emitters thereof, and thus the switching circuit device is sufficiently operable with a power source voltage as low as about 1 V to 1.5 V. Furthermore, the switching circuit device of this invention provides an output signal current having an amplitude which is variable between zero level and the level of the mirror current I0.

Current mirror circuits usable with the switching circuit device according to the present invention are not limited in construction to the embodiment shown in FIG. 2. It is also possible that current mirror circuits 101 to 107 of a different construction such as shown in FIG. 4 may be employed.

Figure 4:
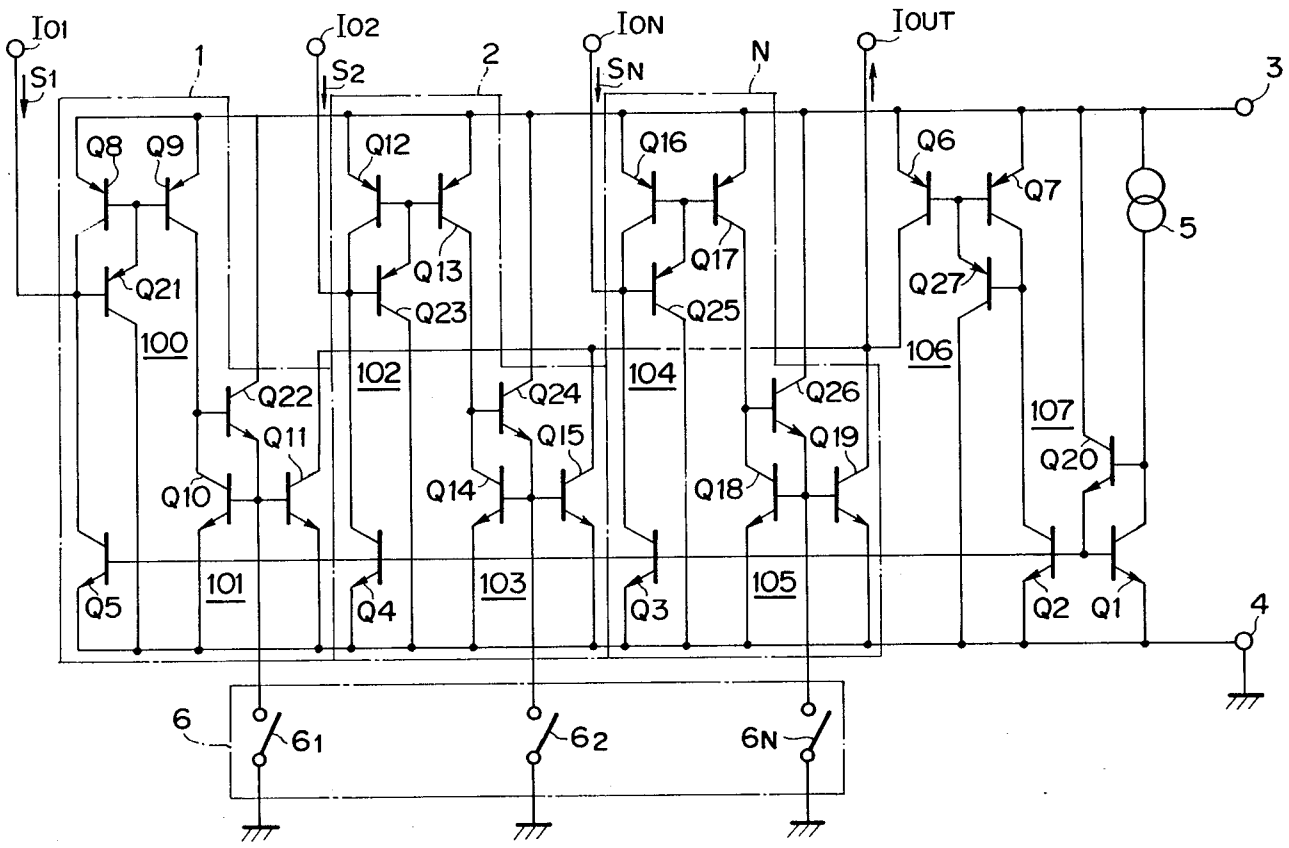
FIG. 4 is a circuit diagram showing the switching circuit device using current mirror circuits according to another embodiment of the present invention.

It will readily be seen that the current mirror circuits shown in FIG. 4 are different in construction from those shown in FIG. 2. In FIG. 4, the current mirror circuit 100, for example, comprises transistors Q8 and Q9 having their bases connected to each other, and a third transistor Q21 having its emitter tied to the connection point between the bases of the transistors Q8 and Q9 and also having its base connected to the collector of the transistor Q8, the collector of the transistor Q21 being grounded. The remaining current mirror circuits 101 to 107 are similarly constructed. By using the current mirror circuits according to the embodiment shown in FIG. 4, it is possible to enhance the accuracy of mirror currents.

As will be appreciated from the above discussion, according to the present invention, the construction of the switching circuit device can be greatly simplified by using the current mirror circuits. Furthermore, the switching circuit device according to the present invention is operable with a power source voltage as low as about 1 V, and thus finds extensive and effective use in various fields.

Another important advantage is such that the switching circuit device according to the present invention does not impart to an input signal any distortion such as is very liable to be caused with a switching circuit comprising differential amplifiers, and thus performs excellent switching functions.

While the present invention has been illustrated and described with respect to some specific embodiments thereof, it is to be understood that the present invention is by no means limited thereto but encompasses all changes and modifications which will become possible within the scope of the appended claims.

I claim:

1. A switching circuit device using current mirror circuits for selecting any desired one of a plurality of signal currents, comprising:

a first current mirror circuit for providing a predetermined mirror current at a signal input stage;

a first group of current mirror circuits for causing signal currents to be superimposed upon said predetermined mirror current so that currents resulting from said superimposition are derived as mirror currents;

a second group of current mirror circuits to which the mirror currents derived from said first group of current mirror circuits are supplied;

a second current mirror circuit connected at a common point to output stages of said second group of current mirror circuits and adapted to supply to said common point a mirror current equal to said mirror current provided by said first current mirror circuit;

a group of switches adapted to render operative one of said second group of current mirror circuits;

an output terminal led out of the connection point between said common point and the output stage of said second current mirror circuit, wherein any one current mirror circuit in said second group of current mirror circuits is rendered operative by operating said group of switches so that a desired one of said plurality of signal currents is selected and derived from said output terminal.

2. A switching circuit device according to claim 1, wherein each of said current mirror circuits comprises a first and a second transistor having bases thereof connected to each other, and a third transistor having an emitter thereof connected to the bases of said first and second transistor, a base of said third transistor being connected to a collector of said first transistor.

* * * * *